US005487688A

United States Patent [19]

Sumigawa

[11] Patent Number: 5,487,688

[45] Date of Patent: Jan. 30, 1996

[54] OUTBOARD MOTOR

[75] Inventor: Yukio Sumigawa, Hamamatsu, Japan

[73] Assignee: Sanshin Kogyo Kabushika Kaisha, Hamamatsu, Japan

[21] Appl. No.: 302,593

[22] Filed: Sep. 8, 1994

[30] Foreign Application Priority Data

Sep. 8, 1993 [JP] Japan ..... 5-247582

[51] Int. Cl.[6] ..... B63H 21/38

[52] U.S. Cl. ..... 440/88; 440/89

[58] Field of Search ..... 440/88, 89; 123/196 R, 123/196 W; 184/1.5, 6.6, 6.18

[56] References Cited

U.S. PATENT DOCUMENTS 3,493,081 2/1970 Tado ..... 440/88

5,232,387 8/1993 Sumigawa ..... 440/89

FOREIGN PATENT DOCUMENTS 331094 2/1991 Japan .

1029338 5/1966 United Kingdom ..... 440/88

*Primary Examiner*—Jesus D. Sotelo

*Attorney, Agent, or Firm*—Knobbe, Martens, Olson & Bear

[57] ABSTRACT

Several embodiments of outboard motors embodying four-cycle engines having an oil tank that is contained within the drive shaft housing and which is surrounded at least in part by a water cooling jacket for maintaining the oil at an acceptable temperature. The oil tank is formed with a cavity through which an exhaust pipe passes and the area between the exhaust pipe and the oil tank forms, in at least some embodiments, an expansion chamber for silencing the exhaust gases. At least in part of the exhaust pipe and/or expansion chamber is also cooled by a water cooling jacket.

28 Claims, 11 Drawing Sheets

OUTBOARD MOTOR

BACKGROUND OF THE INVENTION

This invention relates to an outboard motor and more particularly to an improved oil reservoir and exhaust system therefore.

As is well known, outboard motors are extremely compact arrangements and as a result of their compact nature and the desire to maintain certain portions relatively small and streamlined, a number of design difficulties are encountered.

For example, although two-cycle engines are widely utilized as the power source in an outboard motor, there is a great deal of interest in the use of four-cycle engines for the power plant in an outboard motor. When a four-cycle engine is employed, the positioning of its oil tank presents certain difficulties. These problems are somewhat magnified by the fact that outboard motors normally position the engine so that its crankshaft rotates about a vertically extending axis. As a result of this orientation, the crankcase chamber cannot form the lubricant reservoir as with other applications for four-cycle engines. Thus it is necessary to provide a separate oil reservoir. The placement of this separate oil reservoir presents certain difficulties. If the oil reservoir is positioned beneath the engine in the power head, then the overall height of the outboard motor becomes excessive. This gives rise to a number of problems not the least of which is the difficulty in tilting up the outboard motor as is typical when not in use. Therefore, it has been proposed to position the oil tank for the engine in the drive shaft housing. There are, however, certain disadvantages with doing so.

One disadvantage is that, again, due to the compact nature of outboard motors, the interior of the drive shaft housing is employed for treating the exhaust gases and silencing them before they are discharged to the atmosphere. Frequently, one or more expansion chambers are formed in the drive shaft housing and the exhaust gas is passed downwardly into the drive shaft housing from the power head through an exhaust pipe that depends into the interior of the drive shaft housing.

Because of this arrangement, the positioning of the oil tank for the engine in the drive shaft housing places it in a location where it is likely to be heated. In fact, in some installations the exhaust pipe actually passes through a cavity around which the oil tank extends and thus a large volume of the oil may be directly exposed to the heat of the exhaust gases.

It has been proposed to attempt to cool the oil tank by draining a portion of the engine cooling water over the exterior surface of the oil tank. Although this may be effective, it has some disadvantages. In the first instance, when the oil tank is cooled by draining water over it, there is difficulty in ensuring adequate and complete cooling. In addition, when operating in marine environments, the evaporation of the water from the heart of the oil tank will leave salt deposits on the oil tank and this can cause corrosion and adversely affect the ability to transfer heat.

It is, therefore, a principal object of this invention to provide an improved oil tank arrangement for an outboard motor.

It is a further object of this invention to provide an improved arrangement for cooling the oil tank of an outboard motor.

It is a still further object of this invention to provide a cooling jacket arrangement for the oil tank of an outboard motor wherein the cooling jacket will be filled with water which is circulated during the entire time when the engine is running.

It is a further object of this invention to provide an improved arrangement for cooling not only the oil tank of an outboard motor but also cooling the exhaust within the drive shaft housing of the motor.

As has been previously noted, the interior of the drive shaft housing is frequently employed to provide one or more expansion chambers for silencing and cooling of the exhaust gases before they are discharged to the atmosphere. However, when the oil tank depends into the drive shaft housing, with the type of arrangements previously proposed, the volume of the drive shaft housing that can be employed as an expansion chamber is substantially reduced.

Therefore, it is a still further principle object of this invention to provide an improved oil tank and expansion chamber arrangement for an outboard motor.

In order to reduce the heating of the lubricant in the oil tank from the exhaust gases, it has ben the practice heretofore to form the expansion chambers for the exhaust treatment at an area below the oil tank. Sometimes, however, the lower surface of the oil tank actually forms the upper surface of the expansion chamber. Such an arrangement obviously not only reduces the volume which can be utilized for the expansion chamber but also can promote excess heat transfer to the lubricant.

It is, therefore, a still further object of this invention to provide an improved arrangement for cooling the oil tank and exhaust system of an outboard motor and wherein a portion of the oil tank can be utilized to define an expansion chamber for exhaust silencing due to the cooling of the oil tank.

SUMMARY OF THE INVENTION

A first feature of the invention is adapted to be embodied in an outboard motor comprised of a power head containing an internal combustion engine having an exhaust discharge for discharging exhaust gases from the engine. A drive shaft housing depends from the power head and contains a propulsion device driven by the engine for propelling an associated watercraft. An oil tank for supplying lubricant to the engine depends into the drive shaft housing. A cooling jacket is formed that extends along at least one external wall of the oil tank and means circulate water through the cooling jacket for cooling the oil tank and the lubricant therein.

Another feature of the invention is adapted to be embodied in an outboard motor comprised of a power head containing an internal combustion engine having an exhaust discharge for discharging exhaust gases from the engine. A drive shaft housing depends from the power head and contains a propulsion device driven by the engine for propelling an associated watercraft. An oil tank for supplying lubricant to the engine depends into the drive shaft housing and defines an internal cavity. An exhaust pipe conveys exhaust gases from the exhaust discharge of the engine into the drive shaft housing and extends through the cavity in the oil tank in spaced relationship thereto. The exhaust gases are discharged from the exhaust pipe into an expansion chamber that is formed at least in part by the cavity of the oil tank.

DETAILED DESCRIPTION OF THE PREFERRED EMBODIMENTS OF THE INVENTION

Figure 1:
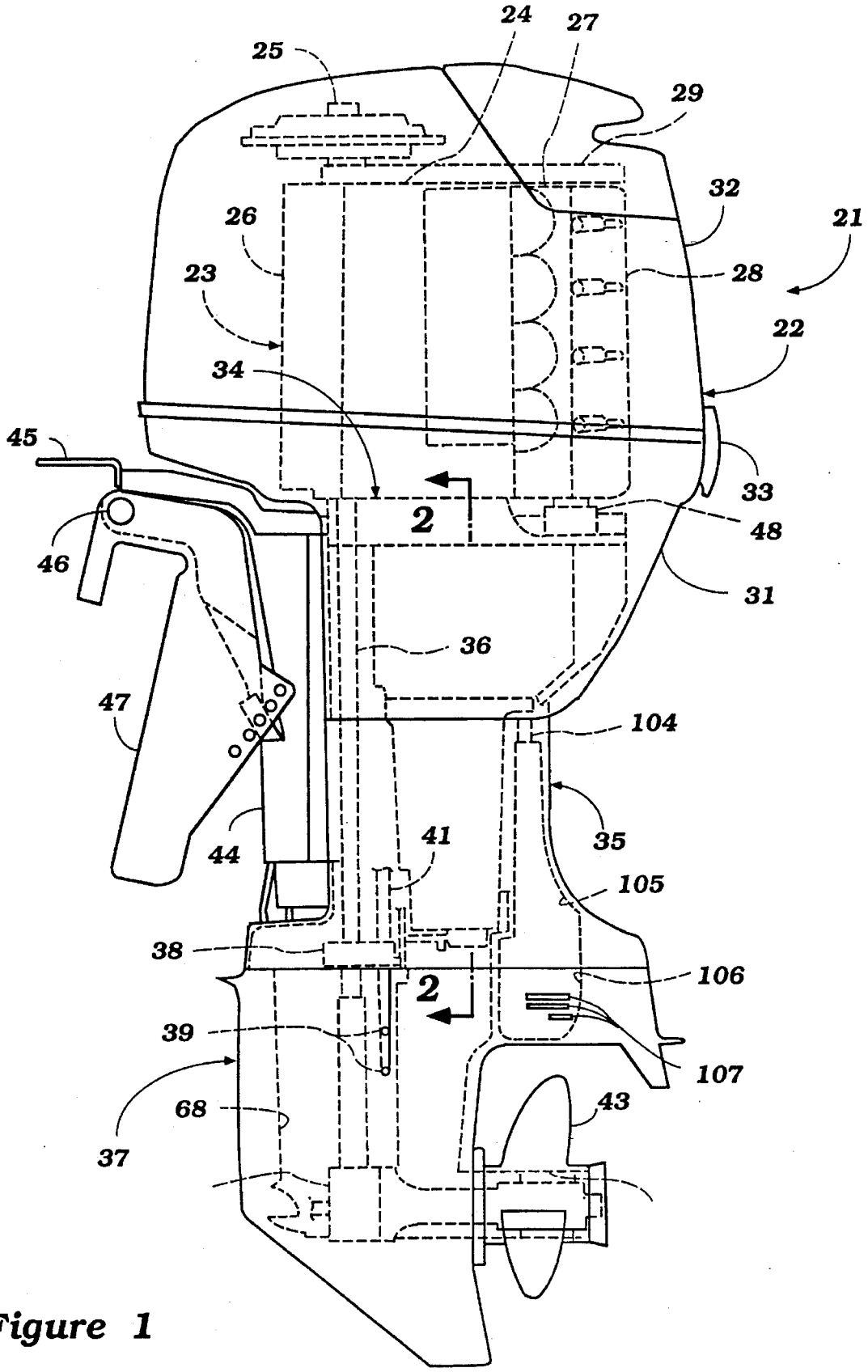
FIG. 1 is a side elevational view of an outboard motor constructed in accordance with a first embodiment of the invention.

Referring now in detail to the drawings and initially to FIG. 1, an outboard motor constructed in accordance with a first embodiment of the invention is identified generally by the reference numeral 21. The outboard motor 21 is comprised of a power head assembly, indicated generally by the reference numeral 22, and which is comprised of a powering internal combustion engine, shown in dotted lines in this figure and indicated generally by the reference numeral 23.

In the illustrated embodiment, the engine 23 is depicted as being of the four-cylinder in-line type that operates on a four-cycle principle. It will be readily apparent to those skilled in the art, however, that the invention may be utilized with engines having a wide variety of cylinder numbers and cylinder types. Also, certain facets of the invention may be employed with rotary engines. In addition, although the invention is described in conjunction with a four-cycle engine, it should be apparent that certain facets of the invention have utility in conjunction with two-cycle engines. However, certain features of the invention have particular utility in conjunction with four-cycle engines because of their lubrication requirements and systems, as will become apparent.

The engine 23 is comprised of a cylinder block 24 in which four horizontally extending, vertically spaced cylinder bores are formed that contain pistons which are connected by means of connecting rods (none of these components being illustrated), which drive a crankshaft 25. As is typical with outboard motor practice, the engine 23 is positioned within the power head 22 so that the crankshaft 25 rotates about a vertically extending axis. The crankshaft 25 is journaled within a crankcase chamber that is formed by the cylinder block 24 and a crankcase member 26 that is affixed to the cylinder block 24 in a known manner.

The engine 23 further includes a cylinder head 27 that is affixed to the cylinder block 26 and which contains a valve mechanism for operating intake and exhaust valves for admitting an intake charge to the combustion chambers of the engine and for exhausting it. This arrangement includes a single overhead camshaft that is contained within a cam chamber closed by a cam cover 28. The camshaft is driven from the crankshaft 25 by means including a timing belt 29.

The construction of the engine 23 as thus far described may be considered to be generally conventional, and since the invention deals primarily with certain facets of the lubrication and exhaust system for the engine 23 where components are not described in more detail or are not illustrated, they may be considered to be conventional.

The remainder of the power head 22 includes a protective cowling that is comprised of a lower tray portion 31 which may be formed from a lightweight, high-strength material such as aluminum or an aluminum alloy or the like. A main cowling portion 32 is affixed to the tray 31 by means that include a latch assembly 33.

The engine 23 is mounted within the cowling assembly as thus far described upon a spacer plate, indicated generally by the reference numeral 34, and which has a construction which will be described later in more detail by reference to certain of the remaining figures. This spacer plate 34 is positioned at the upper end of a drive shaft housing, indicated generally by the reference numeral 35, and which is at least partially, at its upper end, surrounded by the tray 31.

A drive shaft 36 extends through the spacer plate 34 and is rotatably coupled in a well-known manner to the engine crankshaft 25. This drive shaft 36 depends through the drive shaft housing into a lower unit, indicated generally by the reference numeral 37. At the interface between the drive shaft housing 35 and the lower unit 37, the drive shaft 36 is coupled to a water pump 38 which circulates water for cooling of the engine 23 and other purposes, as will be described. This water is drawn through a plurality of inlets 39 formed in the lower unit 37 and is discharged upwardly through a supply conduit 41. These components will be described in more detail later, as will the way in which the water is returned to the body of water in which the watercraft is operating.

As has been noted, the drive shaft 36 depends into the lower unit 37 and there drives a conventional forward/neutral/reverse transmission, indicated by the reference numeral 42, which selectively couples the drive to a propeller 43 that is journaled on a propeller shaft in the lower unit 37 in a known manner for exerting a propulsion force on an associated watercraft.

A steering shaft (not shown) is affixed to the drive shaft housing 35 in a known manner and is journaled for steering movement within a swivel bracket 44. A tiller 45 is affixed to the upper end of this steering shaft for steering of the outboard motor 21 in a manner well known in this art.

The swivel bracket 44 is pivotally connected by means of a pivot pin 46 to a clamping bracket 47. The clamping bracket 47 includes a clamping device by which it may be affixed to a transom of an associated watercraft. The pivotal connection provided by the pivot pin 46 permits the outboard motor 31 to be pivoted to any of a plurality of trim adjusted positions and to a tilted-up out-of-the-water position, as is also well known in this art.

The construction of the outboard motor 21 as thus far described may be considered to be conventional. Therefore, where any components of the outboard motor 21, including those of the engine 23, have not been described in any more detail, they may be considered to be conventional. As has been noted, the invention deals primarily with the treatment of the exhaust gases from the engine 23 and its lubrication system, and these systems will now be described by reference to additional figures, as will be noted.

Specifically, the engine 23 is provided with an internal lubricating system through which lubricant is circulated by means of a lubricant pump, shown schematically at 48. The pump 48 is disposed and driven off the lower end of the aforenoted camshaft and draws lubricant from a lubricant reservoir, which will be described and which is contained in the upper end of the drive shaft housing 35, and circulates it through the engine 23 in any well-known manner. This lubricant is then returned by gravity to the lubricant tank.

The engine 23 is also provided with an exhaust system and, as is typical with outboard motor practice, this exhaust system is formed primarily internally within the cylinder head 27 and cylinder block 24 and may include an exhaust manifold that is formed integrally in the cylinder block 24 and which has a downwardly facing exhaust gas discharge opening. This exhaust gas discharge opening communicates with a corresponding exhaust gas discharge passage 49 (FIGS. 2 and 3) that is formed in the spacer plate 34. A suitable gasket is disposed between the spacer plate 34 and the lower face of the cylinder block 24 around the passage 49 for exhaust gas and other sealing.

The drive shaft housing 35 is formed from a casting of a lightweight material such as aluminum or aluminum alloy and defines an internal .cavity, indicated generally by the reference numeral 51. An assemblage, indicated generally by the reference numeral 52, is affixed to the underside of the support plate 34 by means of a plurality of threaded fasteners 53 and defines between its outer periphery and the inner wall of the drive shaft housing 35 a water-cooling chamber, which is indicated generally at 54. As will become apparent, this water cooling chamber encircles substantially completely the assemblage 52 up to a level that is maintained in a manner to be described.

In the illustrated embodiment, the assemblage includes an upper member, indicated generally by the reference numeral 55, and which may be formed from a material such as aluminum or aluminum alloy so as to maintain a lightweight construction and yet have adequate strength. This member 55 has an exhaust passageway 56 formed at its upper end which communicates with the exhaust discharge opening 49 of the spacer plate.

An exhaust pipe 57 has a flange portion 58 that is affixed to the member 55 and spacer plate 34 by means of fasteners 50. The exhaust pipe 57 depends downwardly into the assemblage 52 and has its upper portion spaced within a cavity 59 formed by an inner wall 61 of the upper member 55. This cavity 59 functions in part as an expansion chamber for silencing the exhaust gases that are discharged into a further expansion chamber portion 62 formed by an inner wall of a lower member 63 of the assemblage 52. It should be noted that the lower member 63 which is connected to the upper member 55 by fasteners 60 is also spaced inwardly from the inner wall of the drive shaft housing 35 so that the water cooling jacket 54 also extends in part around this member.

The lower end of the lower member 63 of the assemblage 52 is formed with a reduced neck 64 that is received within an opening 65 formed in a lower wall 66 of the drive shaft housing 35. A sealing gasket 67 is disposed around the neck 64 and the opening 65 so that exhaust gases may flow downwardly from the expansion chamber formed by the volumes or cavities 59 and 62 into a high-speed exhaust gas discharge 68 formed in the lower unit 37. As may be seen in FIG. 1, this exhaust discharge 68 communicates with a through the hub high-speed underwater exhaust gas discharge 69 formed in the hub of the propeller 43 in a known manner. The flow of gases through the exhaust system under various conditions will be described in more detail later.

The upper member 55 of the assemblage 52 forms the oil tank or lubricant reservoir for the lubricating system of the engine 23, and this reservoir is indicated by the reference numeral 71. It will be seen that the oil reservoir 71 at least partially defines through its inner wall 61 the cavity 59 around the exhaust pipe 57. Lubricant is returned to this oil reservoir 71 from the engine lubricating system through any suitable drain arrangement as will be described.

Lubricant is supplied to the pump 48 from an oil pickup 72 that depends into the oil reservoir 71 and which supplies a conduit 73 that extends upwardly through the spacer plate 34 and through passages formed in the spacer plate 34 and cylinder block 24 and cylinder head 27 so as to supply the lubricant to the oil pump 48. The lubricant return drain appears in FIG. 2 and is identified generally by the reference numeral 74.

The oil pump 48 has a discharge circuit that includes a passage 75 formed in part in the lower surface of the spacer plate 34 and which cooperates with a passage 76 formed in the upper portion of the member 55 of the assemblage 52 so as to place the high-pressure outlet of the oil pump 48 in communication with a pressure relief valve 77 that is formed in part in the upper portion of the member 55. The pressure relief valve 77 limits the maximum pressure in the lubrication system by dumping excess oil back to the reservoir 71 in a manner that is well known in this art.

Figure 3:
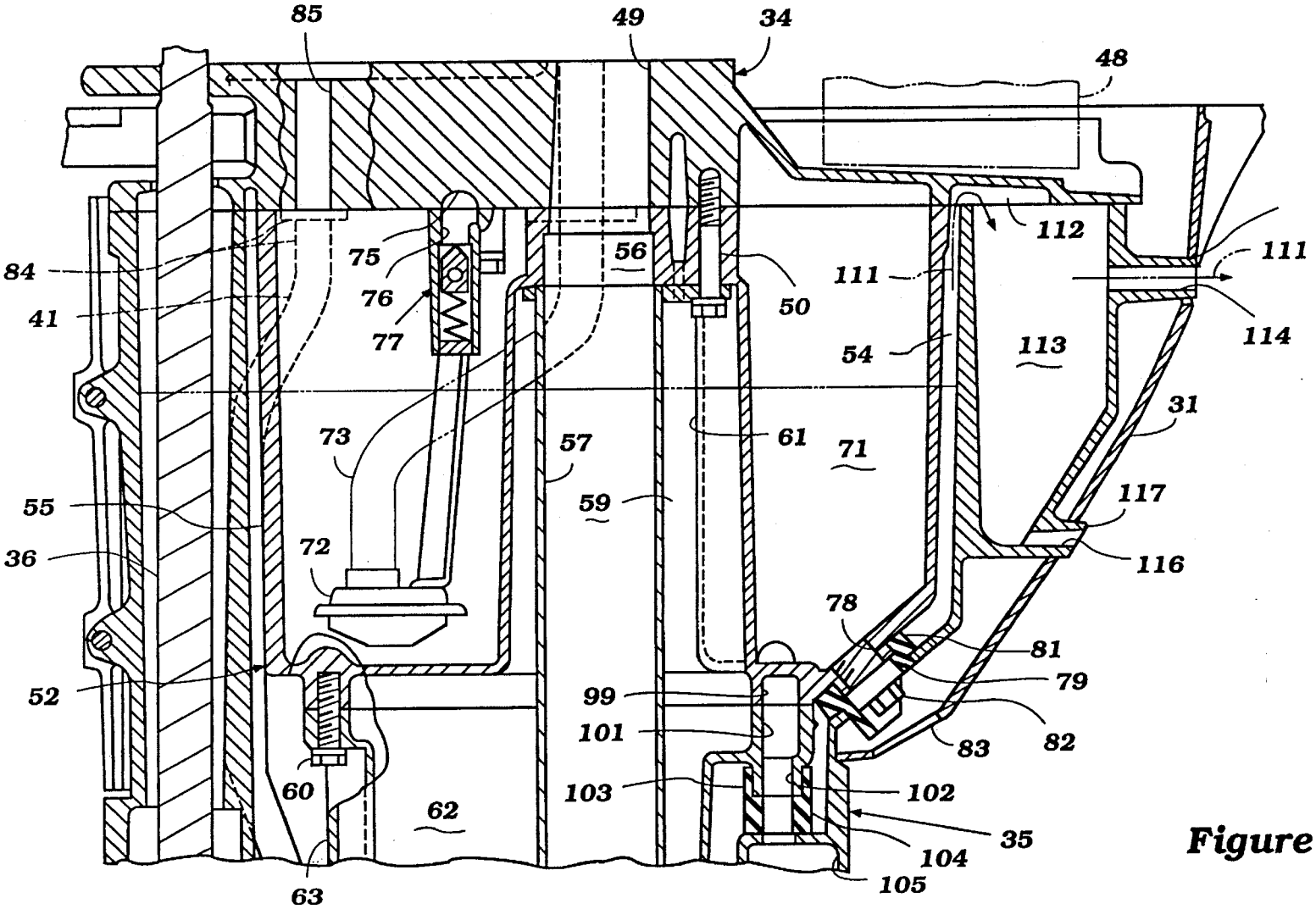
FIG. 3 is a partial cross-sectional view, on an enlarged scale, taken along a plane that extends perpendicular to the plane of FIG. 2 and shows the upper portion of the drive shaft housing.

Even though the oil reservoir 71 is positioned within the drive shaft housing 35, it is still possible to drain the oil from it without disassembly, and to this end there is provided a drain arrangement that is externally accessible and which is shown in FIG. 3. As will be noted, the lower surface of the member 55 and particularly the portion that defines the reservoir 71 is provided with a tapped drain opening 78 that is aligned with a corresponding opening 79 formed in the drive shaft housing 35 at the rear thereof. An elastic gasket 81 provides a seal between the openings 78 and 79. A removable closure plug 82 closes the oil drain 78. The lower tray 31 is provided with an access opening 83 through which the drain plug 82 may be accessed and from which the oil may be drained for servicing.

The engine 23 is provided with an oil fill opening, for example, in its cam cover 26, so that the oil may be replenished by pouring it into the cam cover and then having it returned to the lubricant tank 71 through the drain system, including the drain opening 74 formed in the spacer plate 34.

Figure 2:
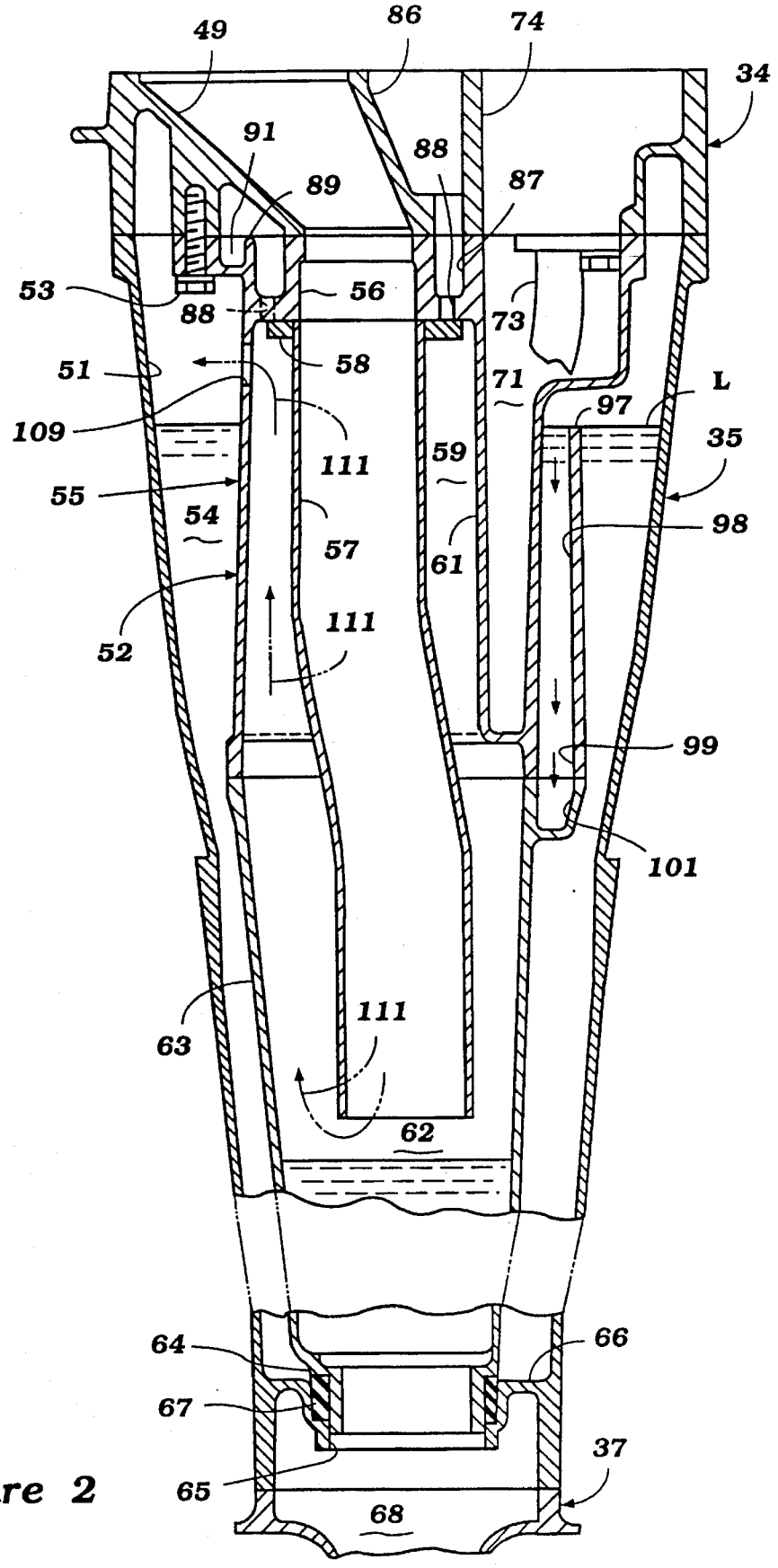
FIG. 2 is a cross-sectional view taken generally along the line 2—2 of FIG. 1.
Figure 5:
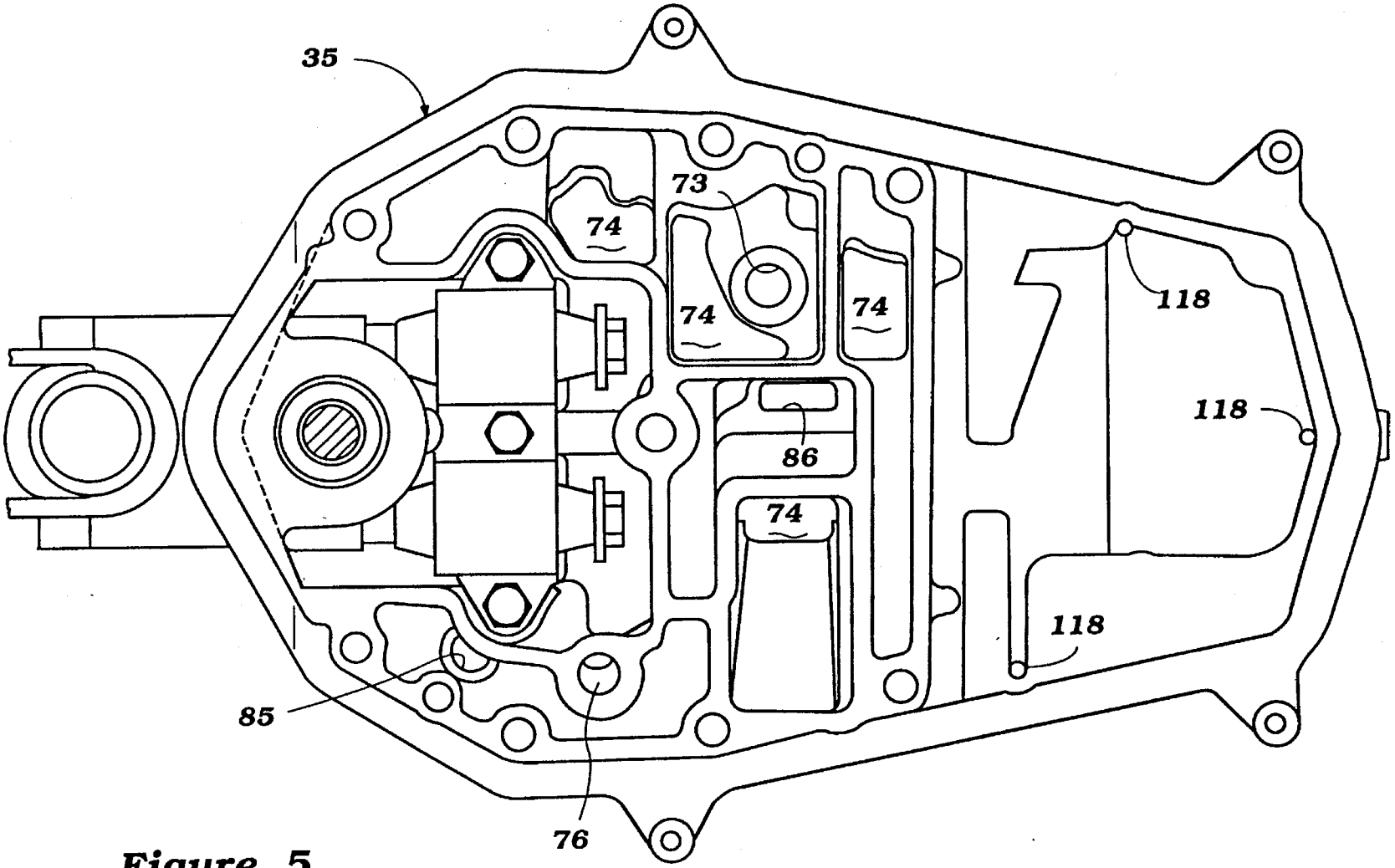
FIG. 5 is a top plan view looking into the drive shaft housing, with the engine and engine supporting plate removed.

The cooling system for the oil tank 71 and portion of the exhaust system that extends through the drive shaft housing 35 will now be described. As has been previously noted, coolant for the engine 23, which is water cooled, is drawn by the water pump 38 through the inlet openings 39 and discharged through the conduit 41 (FIG. 1). This conduit 41 extends upwardly through the drive shaft housing 34 externally of the assemblage 52 and terminates at its upper end in a flange 84 (FIG. 3) that is affixed to the underside of the spacer plate 34. This delivers water to the engine through a passage 85 formed in the spacer plate 34. The manner in which the water is circulated through the engine is not an important feature of the invention, but it should be noted that the spent coolant water is returned from the engine through the spacer plate 34 and specifically a water drain and collecting passage 86 formed therein (FIGS. 2 and 5).

Figure 6:
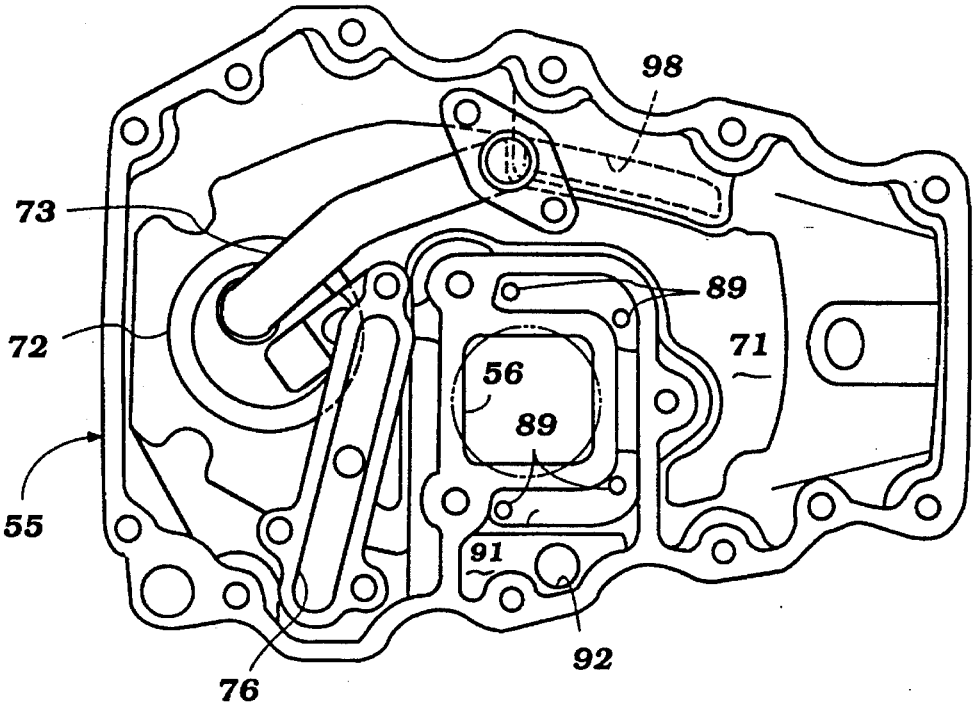
FIG. 6 is a top plan view looking into the oil tank.
Figure 7:
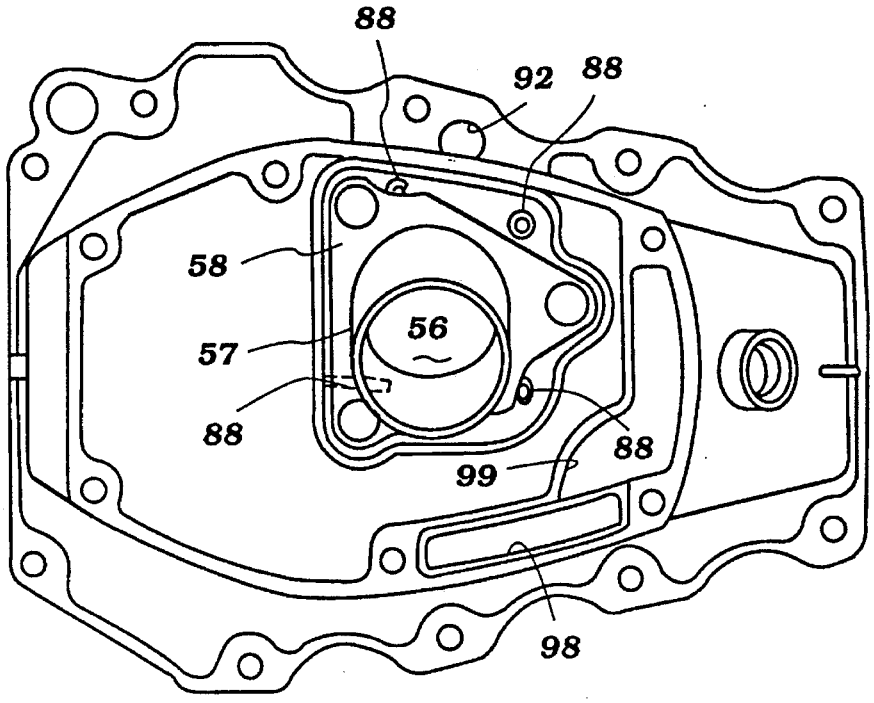
FIG. 7 is a bottom plan view looking at the underside of the oil tank.
Figure 8:
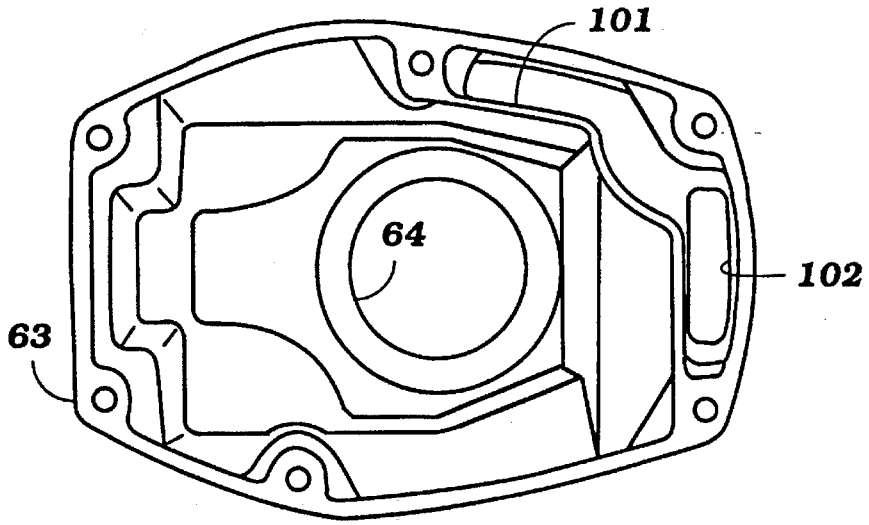
FIG. 8 is a top plan view looking at the top portion of the lower element that forms the expansion chamber.
Figure 9:
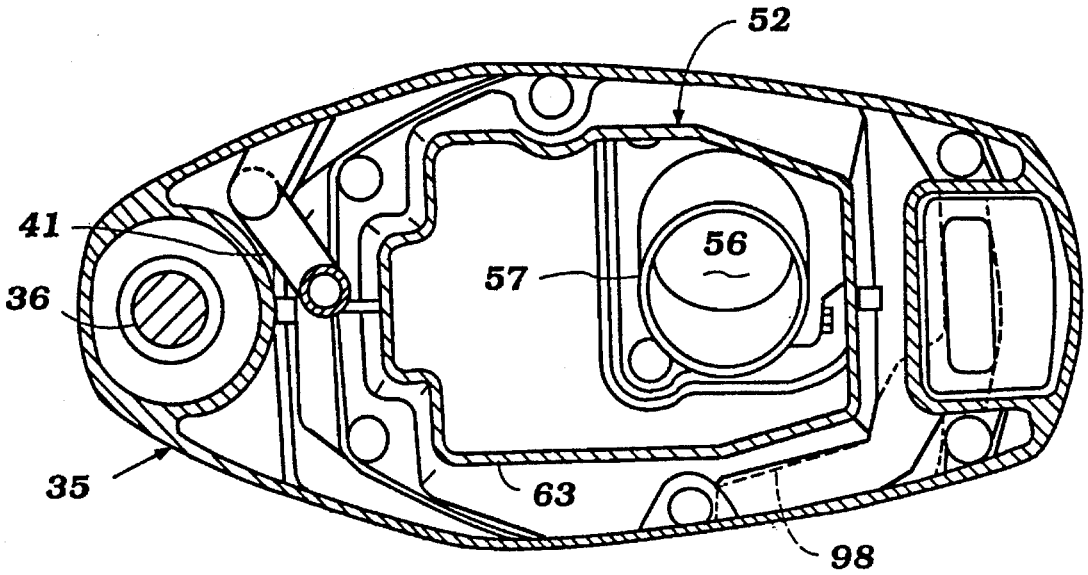
FIG. 9 is a cross-sectional view taken along the line 9—9 of FIG. 4.

This coolant is then delivered to an annular cooling chamber 87 formed in the upper member 58 around its exhaust passage 56. A portion of this water is drained into the exhaust system for cooling and silencing purposes, and for this purpose there are provided a plurality of circumferentially spaced drain openings 88 (FIGS. 2 and 6) which extend around the exhaust pipe 58 and drain downwardly through recesses formed in the flange 58. The flange 58 and these recesses which direct the water radially outwardly into contact with the inner periphery of the wall 61 of the member 56 which defines both the upper expansion chamber 59 and a portion of the inner periphery of the oil tank 71. Hence, this water will serve to cool and silence the exhaust gases and also to provide some cooling for the inner portion of the oil tank 71. This cooling also assists in permitting the void area 59 around the exhaust pipe 57 to be utilized as an expansion chamber. Previously, this was not feasible because of the fact that the desire was to avoid any heat transfer to the oil tank, but with this construction, since the oil tank is well cooled, this is not a problem.

The proportion of the cooling water delivered to the expansion chamber area 59 is relatively small, except,under low-speed running conditions. The bulk of the water from the engine flows over a weir-type wall 89 into a chamber 91 (FIGS. 2 and 6) formed at one side of the member 55 beyond the outer periphery of the chamber 59 and oil tank 71. A drain opening 92 is formed at the lower end of this wall and lets the bulk of the cooling water from the engine enter the liquid cooling jacket 54.

The height of the water in the cooling jacket 54 is maintained at a level L1 by a weir-type ,device that is comprised of a horizontally extending wall 97 formed by the upper member 55 of the assemblage 52 and which defines a flow channel 98 that is formed at a localized area in the cooling jacket 54. This channel 98 extends downwardly through an opening at the lower end of the member 55, indicated by the reference numeral 99, which communicates with a collector recess 101 formed in the upper surface of the lower member 63.

A drain port 102 is formed by a nipple 103 on the upper portion of the member 63 and communicates through a flexible hose 104 with a drain passage 105 formed in the interior of the drive shaft housing. This drain passage 105 communicates with a corresponding drain 106 formed in the lower unit 37 that permits water to flow back to the body of water in which the watercraft is operating through drain openings 107.

As a result of this arrangement, it should be readily apparent that the oil tank 71 and also the expansion chambers 59 and 62 are encircled in substantial part by the water jacket 54. Hence there will be very effective cooling of the exhaust system and oil tank that provides not only good silencing and sound control but also long life for the engine 23. In addition, since the cooling jacket 54 is filled with water all of the time when the engine is operating, there will not be a problem with the formation of deposits on the outer surface of either the oil tank 71 or the expansion chamber walls.

Figure 4:
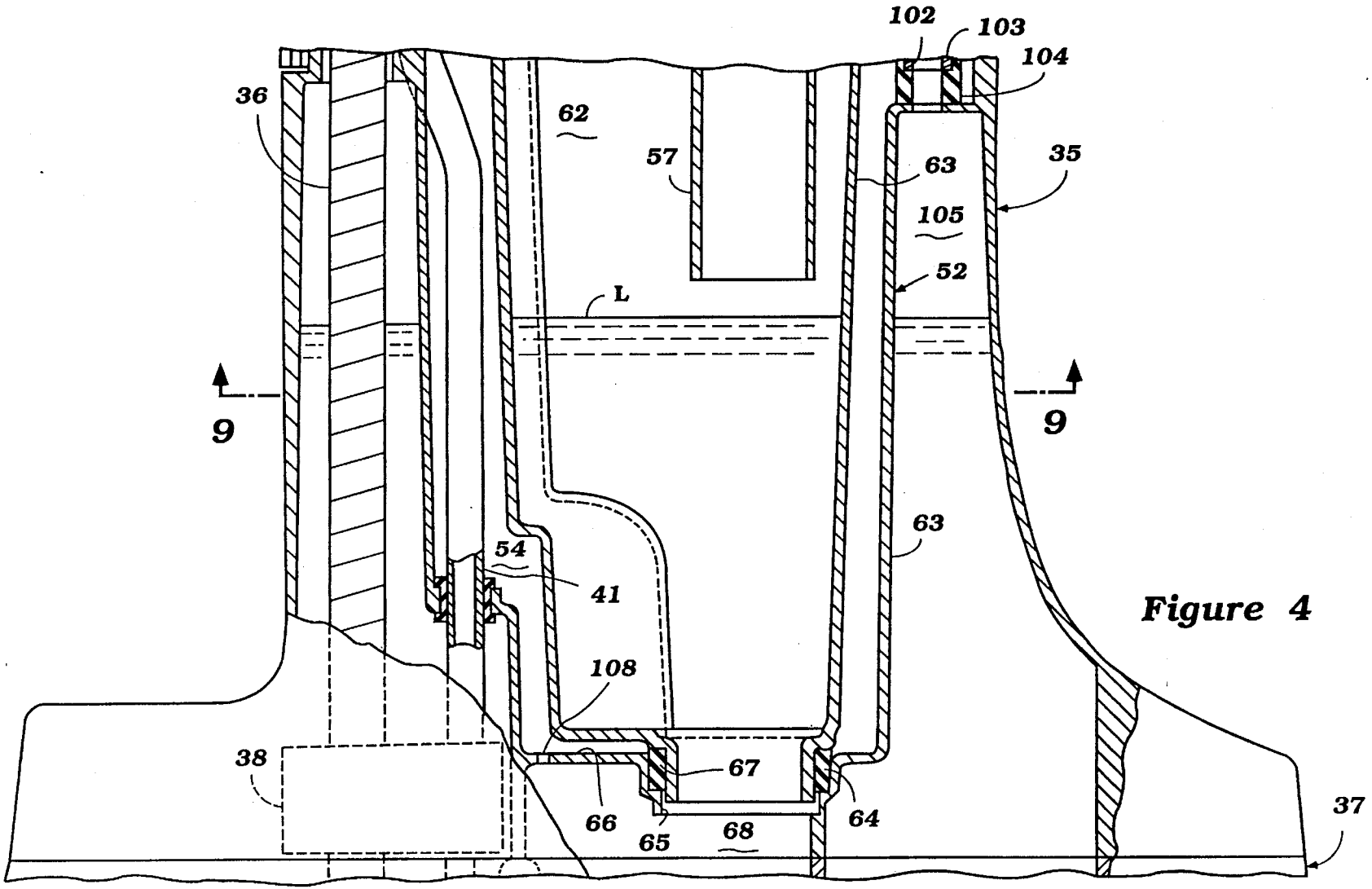
FIG. 4 is an enlarged cross-sectional view taken along the same plane as FIG. 3 and shows the construction at the lower portion of the drive shaft housing.

In order to provide drainage of water from the cooling jacket 54 when the outboard motor 21 is tilted up to its out-of-the-water condition, a small bleed opening 108 (FIG. 4) is provided that will drain the cooling jacket 54 to the body of water through the high-speed exhaust gas discharge passages 68 and 69.

The path of discharge of the exhaust gases from the engine through the exhaust pipe 57, expansion chambers formed by the areas 59 and 62, lower unit discharge openings 66 and 68, and through the hub propeller discharge 69 has already been described. As is well known in this art, when the associated watercraft is being propelled at a high speed by the outboard motor 21, the lower unit 37 will be only shallowly submerged, and there will be sufficient pressure of the exhaust gases for them to exit through this path. When traveling at a slow rate of speed or when idling, however, the water level will reach a higher level, as indicated by the line L in FIGS. 2 and 3, and under these circumstances the exhaust gases cannot easily exit through the underwater exhaust gas discharge path previously described. Therefore, there is provided a further above the water exhaust gas discharge path, which will now be described by particular reference to FIGS. 2–4. This permits the exhaust of the gases to the atmosphere under this condition through and above the water exhaust gas discharge path. It will be seen that the assemblage 52, and particularly the upper member 55 thereof, is provided with a restricted opening 109 (FIG. 2) through which the exhaust gases pass, as indicated by the arrows 111. These exhaust gases then flow above the body of water in the cooling jacket 57 to the rear of the outboard motor, as shown in FIG. 3. The exhaust gases then can flow through a restricted passageway 112 formed in the lower surface of the spacer plate 34 to an expansion chamber 113 formed at the rear of the drive shaft housing 35 in an area covered by the tray 41.

It should be noted that some water may also be present in these exhaust gases, and the expansion in the area above the cooling jacket 54 after passing through the restricted opening 109, subsequent restriction in the passage 112, and expansion in the chamber 113 will tend to cause this water to separate and be deposited in the lower portion of the expansion chamber 113. In addition, this expansion and contraction of the exhaust gases causes silencing for the idle or low-speed exhaust gas discharge to the atmosphere through a passage 114 formed in the upper portion of the expansion portion 113 and which extends through an opening 115 in the rear of the tray 31.

Water which has condensed in the chamber 113 will be drained through a water drain 116 formed at the lower end of the expansion chamber 113 in the upper portion of the drive shaft housing 35. This water drain 116 extends through an opening 117 formed in the tray 31. Both the openings 114 and 116 are disposed above the water level when the associated watercraft is either stationary or traveling at a low rate of speed.

As may be seen in FIG. 5, the lower portion of the rearwardly extending part of the drive shaft housing 35 is provided with three spaced water drains 118 that will permit any water which has entered the protective cowling to be drained downwardly and discharged with the cooling water from the water jacket 54.

Figure 10:
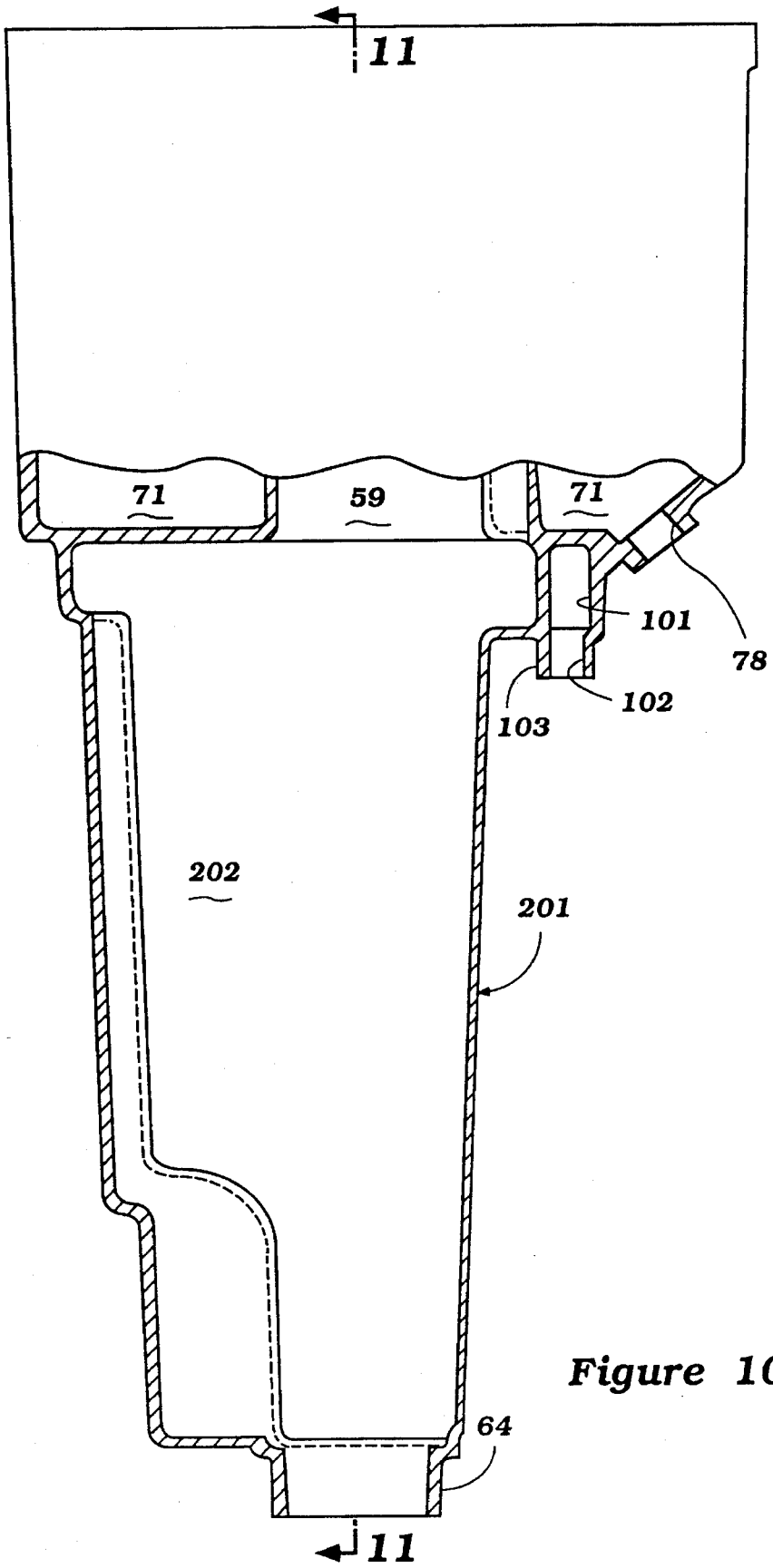
FIG. 10 is a side elevational view looking in the same direction as FIGS. 3 and 4 with a portion broken away and shown in section, showing the expansion chamber oil tank forming member in accordance with another embodiment of the invention.
Figure 11:
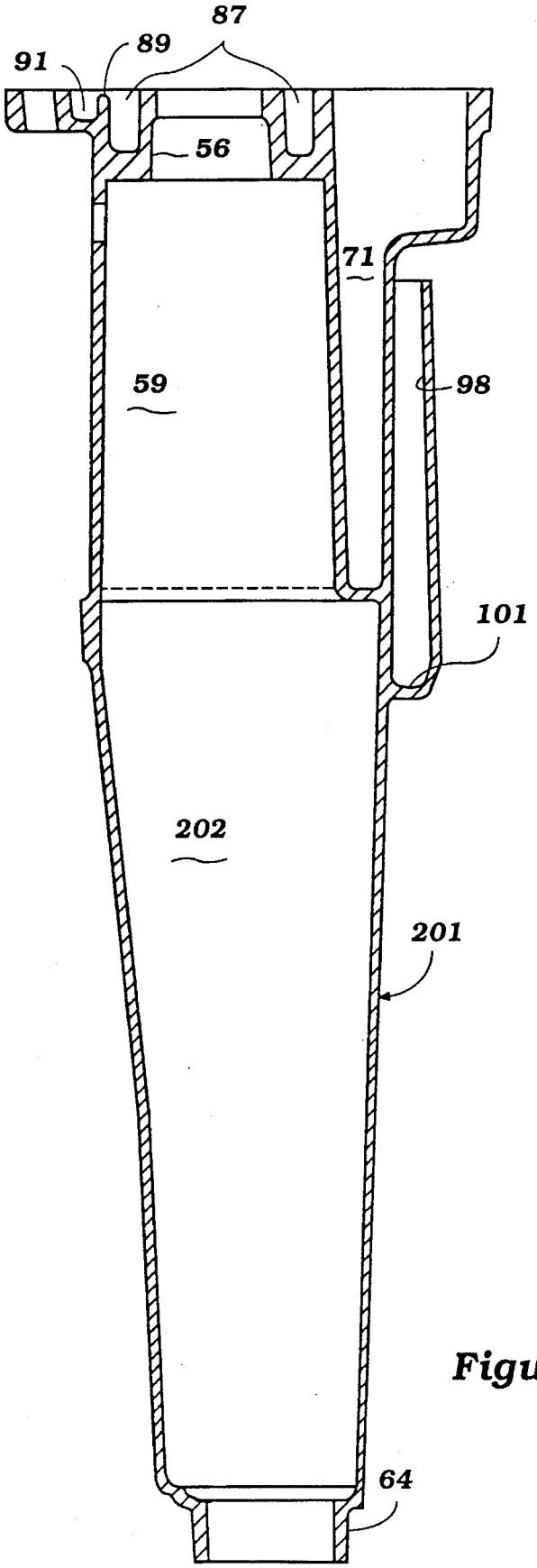
FIG. 11 is a cross-sectional view taken along the line 11—11 of FIG. 10.

In the embodiment of the invention as thus far described, the assemblage 52 has been formed of a two-part construction consisting of the upper member 55 and the lower member 63. In some regards, this two piece construction permits a more easily formed arrangement and permits the insertion of the exhaust pipe into the housing assembly. FIGS. 10 and 11 show another embodiment of the invention wherein the assembly that comprises the expansion chamber and oil tank is all formed from a single unitary casting, indicated generally by the reference numeral 201.

This casting 201 has generally the same configuration as the assembly 52 of the previously described embodiment, and where that is the case, components which are the same or substantially the same have been identified by the same reference numeral. Since this construction is basically the same as that previously described, a further description of the configuration of the oil tank 71 and expansion chamber comprised of the upper portion 59 and lower portion 62, which are one piece, as indicated at 202 in these figures, is not believed to be necessary to enable those skilled in the art to practice the invention.

It should be noted that in this embodiment, an exhaust pipe is not illustrated as depending into the chamber 202. Of course, such an exhaust pipe can be appropriately positioned in this embodiment, but must be connected from the upper side of the unit 201, rather than through the bottom as with the two-piece construction of the previous embodiment. Also, if desired, the exhaust pipe may be eliminated, but if this is done, then the benefits of the tuning effect of such exhaust pipes will be lost.

Figure 12:
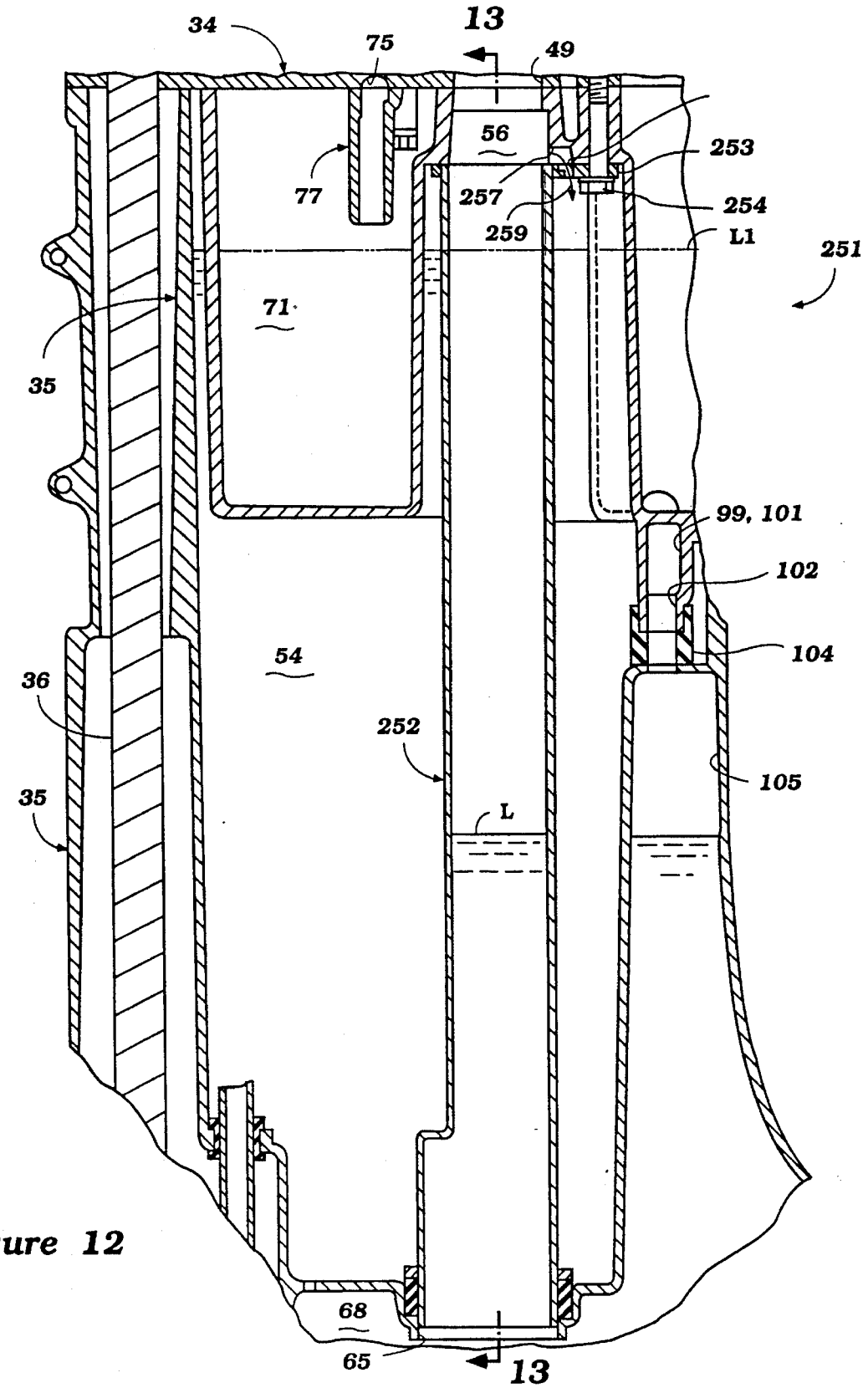
FIG. 12 is a cross-sectional view, in part similar to FIGS. 3 and 4, and shows a still further embodiment of the invention.
Figure 13:
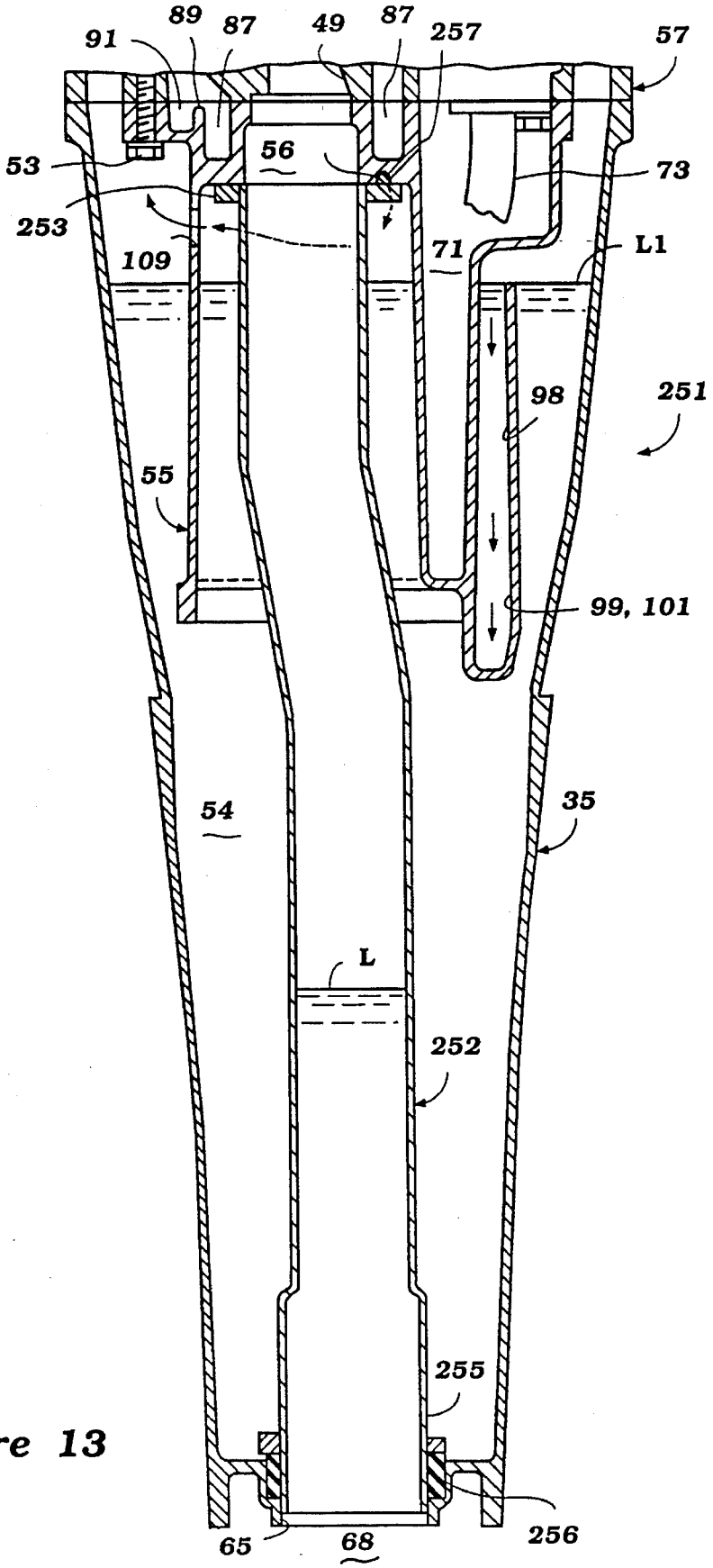
FIG. 13 is a cross-sectional view taken along the line 13—13 of FIG. 12.

FIGS. 12 and 13 show another embodiment of the invention where the outboard motor is indicated generally by the reference numeral 251. This embodiment differs from the previously described embodiments in that it eliminates the use of a separate expansion chamber formed within the drive shaft housing 35 to provide the additional silencing effect. As a result of this, the assemblage 52 is comprised of only the upper member 55. The lower member 63 is deleted in its entirety. Except for these two distinctions, the construction and operation of this embodiment is the same as that previously described, and for that instance, where components are the same or substantially the same, they have been identified by the same reference numerals and will be described again only by reference to these figures so as to understand the distinctions between this embodiment and that previously described.

Since the expansion chamber comprised of the upper portion 59 and lower portion 62 is deleted, the oil reservoir 71, and specifically all of its external walls, are cooled and directly surrounded by the water jacket 54. Because of this, a different low-speed exhaust gas discharge path is provided, and the exhaust pipe, indicated generally by the reference numeral 252, has a slightly different configuration. In addition, the weir discharge arrangement, which was formed by the pieces 55 and 63, is all formed within the piece 55 but has the same construction and operation, and hence its parts have been identified by the same reference numerals, although these parts are formed all in the upper member 55 rather than partially in this member and the lower member 63.

As may be seen, the exhaust pipe 252 has a flange 253 at its upper end that is affixed to the lower portion of the member 55 in a suitable manner as by fasteners 254. Since in this embodiment the exhaust pipe 252 is completely surrounded by the cooling jacket 54 up to the water level L1, it is not necessary to introduce any water directly around the outer periphery of the exhaust pipe as with the previously described embodiments so the passages 88 may be deleted. However, if desired, they can be employed.

The exhaust pipe 252 has a lower portion 255 that extends into the drive shaft housing opening 65 and which receives a sealing gasket 256 therebetween so that under high-speed conditions the exhaust gases will all be discharged downwardly to the chamber 68 for discharge through the underwater high-speed exhaust gas discharge. As has previously been noted, this may comprise a through the hub propeller discharge.

Under low-speed conditions, however, the water level will reach the level L, as shown in the FIGS. 12 and 13, and the pressure of the exhaust gases will not be sufficient to exit from this underwater exhaust gas discharge. Therefore, the upper portion of the member 55 is provided with a restricted radially extending passageway 257 (FIG. 12) that communicates with the conduit opening 56 at the upper end of the exhaust pipe 252. This opening communicates with a corresponding opening 258 formed in the flange 253 so that the exhaust gases may follow the path indicated by the arrows 259 under low-speed conditions. These exhaust gases then exit the area in the cooling chamber 54 above the water level L1 and flow around the exhaust pipe and exit from the member 55 through the aforenoted opening 109 (FIG. 13) for discharge through the aforedescribed above-the-water exhaust gas discharge.

It should be readily apparent from the foregoing description that the described embodiments of the invention provide a very effective exhaust and oil reservoir arrangement for outboard motors that will provide good cooling of not only the exhaust gases but also the oil in the oil reservoir. In addition, by surrounding the components by a large water jacket, silencing from mechanical noises is also achieved. Of course, the foregoing description is that of preferred embodiments of the invention, and various changes and modifications may be made without departing from the spirit and scope of the invention as defined by the appended claims.

I claim:

1. An outboard motor comprised of a power head containing an internal combustion engine having an exhaust discharge for discharging exhaust gases from said engine, a drive shaft housing depending from said power head and containing a propulsion device driven by said engine for propelling an associated watercraft, an oil tank for supplying lubricant to said engine depending into said drive shaft housing, a cooling jacket extending along at least one external wall of said oil tank, and means for circulating water through said cooling jacket for cooling said oil tank and the lubricant contained therein, said cooling jacket being defined by an upstanding wall, the upper edge of a portion of which forms a weir and wherein said means for circulating water delivers water to said cooling jacket and the level of coolant being maintained by said weir.

2. An outboard motor as in claim 1, wherein the cooling jacket extends around substantially the entire surface of the oil tank.

3. An outboard motor as in claim 1, wherein the engine is water cooled and the means for circulating water through the cooling jacket circulates water that has passed through a cooling jacket of the engine.

4. An outboard motor as in claim 3, wherein the cooling jacket extends around substantially the entire surface of the oil tank.

5. An outboard motor as in claim 1, wherein the oil tank defines an internal cavity land further including an exhaust pipe extending from the engine exhaust discharge through the cavity and terminating within the drive shaft housing.

6. An outboard motor as in claim 5, wherein there is formed in the drive shaft housing an expansion chamber into which the exhaust gases from the exhaust pipe are discharged, the cavity of the oil tank surrounding the exhaust pipe forming at least a portion of said expansion chamber.

7. An outboard motor as in claim 6, wherein the cooling jacket extends at least in part around the expansion chamber.

8. An outboard motor as in claim 7, wherein the cooling jacket extends around substantially the entire periphery of the oil tank.

9. An outboard motor as in claim 7, wherein the engine is water cooled and the means for circulating water through the cooling jacket circulates water that has passed through a cooling jacket of the engine.

10. An outboard motor as in claim 9, wherein the cooling jacket extends around substantially the entire periphery of the oil tank.

11. An outboard motor as in claim 7, wherein the expansion chamber communicates with a high-speed underwater exhaust gas discharge formed at the lower end of the drive shaft housing.

12. An outboard motor as in claim 11, wherein the expansion chamber further communicates with an above-the-water exhaust gas discharge for discharging exhaust gases above the water level when traveling at low speeds or when the watercraft is stationary, said above-the-water exhaust gas discharge including at least one expansion chamber.

13. An outboard motor as in claim 7, wherein the oil tank cavity is spaced outwardly from the exhaust pipe and forms at least in part the expansion chamber.

14. An outboard motor as in claim 13, wherein the means for circulating water also introduces water into the cavity between the oil tank and the exhaust pipe for cooling the exhaust pipe.

15. An outboard motor as in claim 14, wherein there is provided a baffle plate that directs the water flow toward the internal surface of the oil tank around the cavity for cooling that portion of the oil tank.

16. An outboard motor comprised of a power head containing an internal combustion engine having an exhaust discharge for discharging exhaust gases from said engine, a drive shaft housing depending from said power head and containing a propulsion device driven by said engine for propelling an associated watercraft, an oil tank for supplying lubricant to said engine depending into said drive shaft housing and defining a cavity passing therethrough, means within said drive shaft housing cooperating with said cavity for forming an open expansion chamber comprised of said cavity and a volume below said cavity and in open communication with said cavity, an exhaust pipe affixed to said exhaust gas discharge and depending into said drive shaft housing through said cavity expansion chamber, and means for discharging exhaust gases from said expansion chamber to the atmosphere.

17. An outboard motor as in claim 16 further including a cooling jacket disposed in direct cooling relation to an outer wall of said expansion chamber and means for circulating cooling water through said cooling jacket.

18. An outboard motor as in claim 16, wherein the cooling jacket is defined by an upstanding wall, the upper edge of a portion of which forms a weir and wherein the means for circulating water delivers water to the cooling jacket and the level of coolant is maintained by the weir.

19. An outboard motor as in claim 16, wherein the cooling jacket extends around substantially the entire periphery of the oil tank.

20. An outboard motor as in claim 19, wherein the cooling jacket is defined by an upstanding wall, the upper edge of a portion of which forms a weir and wherein the means for circulating water delivers water to the cooling jacket and the level of coolant is maintained by the weir.

21. An outboard motor as in claim 16 wherein the engine is water cooled and the means for circulating, water through the cooling jacket circulates water that has passed through a cooling jacket of the engine.

22. An outboard motor as in claim 21, wherein the cooling jacket is defined by an upstanding wall, the upper edge of a portion of which forms a weir and wherein the means for circulating water delivers water to the cooling jacket and the level of coolant is maintained by the weir.

23. An outboard motor as in claim 21, wherein the cooling jacket extends around substantially the entire periphery of the oil tank.

24. An outboard motor as in claim 23, wherein the cooling jacket is defined by an upstanding wall, the upper edge of a portion of which forms a weir and wherein the means for circulating water delivers water to the cooling jacket and the level of coolant is maintained by the weir.

25. An outboard motor as in claim 16, wherein the expansion chamber communicates with a high-speed underwater exhaust gas discharge formed at the lower end of the drive shaft housing.

26. An outboard motor as in claim 25, wherein the expansion chamber further communicates with an above-the-water exhaust gas discharge for discharging exhaust gases above the water level when traveling at low speeds or when the watercraft is stationary, said above-the-water exhaust gas discharge including at least one expansion chamber.

27. An outboard motor as in claim 16, wherein the means for circulating water also introduces water into the cavity between the oil tank and the exhaust pipe for cooling the exhaust pipe.

28. An outboard motor as in claim 27, wherein there is provided a baffle plate that directs the water flow toward the internal surface of the oil tank around the cavity for cooling that portion of the oil tank.

* * * * *